US005516263A

United States Patent [19]

Nishida et al.

[11] Patent Number: 5,516,263

[45] Date of Patent: May 14, 1996

[54] CENTRIFUGAL COMPRESSOR AND VANED DIFFUSER

[75] Inventors: Hideo Nishida; Hiromi Kobayashi; Haruo Miura; Hiroto Yoshikai; Sadashi Tanaka, all of Ibaraki, Japan

[73] Assignee: Hitachi, Ltd., Japan

[21] Appl. No.: 232,668

[22] Filed: Apr. 25, 1994

[30] Foreign Application Priority Data

Apr. 28, 1993 [JP] Japan ..... 5-102798

[51] Int. Cl.[6] ..... F04D 29/46

[52] U.S. Cl. ..... 415/208.2; 415/208.4

[58] Field of Search ..... 415/208.1, 208.2, 415/208.3, 208.4

[56] References Cited

U.S. PATENT DOCUMENTS

| | | | |
|---|---|---|---|
| 1,771,711 | 7/1930 | Hahn | 415/208.4 |
| 3,424,372 | 1/1969 | Blattner et al. | 415/208.4 |
| 3,861,826 | 1/1975 | Dean, Jr, | 415/208.4 |
| 4,824,325 | 4/1989 | Bandukwalla . | |
| 4,850,795 | 7/1989 | Bandukwalla | 415/208.4 |
| 4,877,370 | 10/1989 | Nakagawa et al. | 415/208.4 |
| 5,316,441 | 5/1994 | Osborne | 415/208.4 |

FOREIGN PATENT DOCUMENTS

| | | | |
|---|---|---|---|
| 0556895 | 8/1993 | European Pat. Off. . | |
| 573559 | 3/1933 | Germany . | |
| 1053714 | 3/1959 | Germany . | |
| 3835622 | 5/1989 | Germany . | |
| 53-119411 | 10/1978 | Japan . | |
| 58149 | 5/1979 | Japan | 415/208.4 |
| 38198 | 2/1986 | Japan | 415/208.4 |
| 61-93299 | 12/1986 | Japan . | |
| 63-9500 | 1/1988 | Japan . | |
| 63-45599 | 11/1988 | Japan . | |
| 317623 | 11/1956 | Switzerland . | |
| 879047 | 11/1981 | U.S.S.R. | 415/208.4 |

OTHER PUBLICATIONS

Journal of Basic Engineering, Sep. 1970, pp. 419 and 422, Evaluation of a High Hub/Tip Ratio Centrifugal Compressor.

*Primary Examiner*—John T. Kwon

*Attorney, Agent, or Firm*—Evenson, McKeown, Edwards & Lenahan

[57] ABSTRACT

A centrifugal compressor comprises a centrifugal impeller and a vaned diffuser. The diffuser includes a pair of diffuser plates and a plurality of guide vanes arranged between the pair of diffuser plates in a circular cascade manner. The guide vanes are equal in leading-edge radius to each other, but are different in length from each other. At least one short guide vane is arranged between the adjacent long guide vanes. The total number of the guide vanes is more than the number of blades of the impeller. A throat is formed in only a part of flow passages between the guide vanes.

5 Claims, 7 Drawing Sheets

CENTRIFUGAL COMPRESSOR AND VANED DIFFUSER

BACKGROUND OF THE INVENTION

The present invention relates to centrifugal compressors and diffusers and, more particularly, to a centrifugal compressor and a vaned diffuser which have performance thereof of high efficiency and low noise.

In centrifugal compressors, conventionally a vaned diffuser has been often used when high efficiency is required. These are disclosed in Japanese Utility Model Examined Publication No. 63-45599 and the like, for example. In such centrifugal compressor having the vaned diffuser, flow of fluid is guided by guide vanes so that flow angle measured from a tangential direction increases, and the flow of fluid is turned into a radial direction. Thus, the flow is efficiently decelerated. In this manner, performance of the centrifugal compressor having the vaned diffuser generally increases in efficiency, as compared with a case of a vaneless diffuser. In the vaned diffuser, however, throats are generally formed or defined respectively in passages between the adjoining guide vanes. Accordingly, choke occurs at large flow rate, and deceleration from a diffuser inlet to the throat increases at low flow rate so that the flow stalls and surge occurs. Thus, the prior art has a problem that operating range of compressor having the vaned diffuser is less than that of compressor having the vaneless diffuser. Further, flow of the fluid at an impeller outlet of the centrifugal compressor is non-uniform or uneven in a peripheral direction, that is, in a vane pitch direction. Accordingly, periodically fluctuating flow enters into the diffuser. Frequency of the fluctuating flow is equal to blade passage frequency of the impeller, that is, (the number of blades of the impeller)×(rotational frequency). Accordingly, since the fluctuating flow impinges against the guide vanes of the diffuser, compressor with the vaned diffuser has a problem that high noise which prevails by a blade passage frequency component is generated as compared with compressor with the vaneless diffuser.

Moreover, in order to solve the problem that the operating range of compressor having the vaned diffuser is narrow, a diffuser which is low in solidity (vane length/cascade average pitch) has been invented and disclosed in Japanese Patent Unexamined Publication No. 53-119411. In the vaned diffuser, throats are not formed in passages between blades. Accordingly, choke and surge are difficult to be generated. Thus, the operating range of compressor with low salidity vaned diffuser is wide in the same degree or extent as that of compressor with the vaneless diffuser and is high in performance, but a problem that noise is high has not been solved. Furthermore, as disclosed in Japanese Utility Model Unexamined Publication No. 63-9500, a diffuser has also been proposed in which long guide vanes and short guide vanes are alternately arranged, and radii of tailing edges of all of the guide vanes are made constant. Further, as disclosed in U.S. Pat. No. 4,824,325, a vaned diffuser has also been proposed in which guide vanes having low solidity are provided in two rows, a space in a radial direction is provided between a first row of guide vanes and a second row of guide vanes, and the number of guide vanes of the first row is twice the number of guide vanes of the second row. Centrifugal compressors having such diffusers are characterized to have wide operating range as compared with a centrifugal compressor having a conventional vaned diffuser. However, a problem that noise is high has not been solved.

As described above, the centrifugal compressor provided with the vaned diffuser is generally high in efficiency as compared with the centrifugal compressor which has the vaneless diffuser, but has a disadvantage that the operating range is narrow. A centrifugal compressor which has solved the problem to have a wide operational range has been proposed. However, a problem that the noise is high has not still been solved.

SUMMARY OF THE INVENTION

It is an object of the invention to provide a centrifugal compressor provided with a vaned diffuser, and the vaned diffuser, which have characteristics that efficiency is high, operating range is wide and noise is also low.

In order to achieve the above-described object, the invention is arranged such that guide vanes of a vaned diffuser of a centrifugal compressor are formed by two kinds of long and short guide vanes which are equal to each other in radius of a leading edge, but which are different from each other in length, at least one short guide vane is arranged between the adjacent pair of long guide vanes, and the total number of the two kinds of guide vanes is more than the number of vanes of an impeller.

Further, the invention is arranged such that guide vanes of a vaned diffuser of a centrifugal compressor are arranged in the form of two rows circular cascades, the number of guide vanes of an inner circular cascade is more than the number of blades of an impeller, angles of the guide vanes of the inner circular cascade are substantially constant in a flow direction, and radii of leading edges of the guide vanes of the inner circular cascade vary in a direction of vane height.

Moreover, the invention is arranged such that guide vanes of a vaned diffuser of a centrifugal compressor are arranged in the form of two rows circular cascades, the number of guide vanes of an inner circular cascade is more than the number of guide vanes of an outer circular cascade and is more than the number of blades of an impeller, and radii of leading edges of the guide vanes of the outer circular cascade are the same in order as radii of trailing edges of guide vanes of the inner circular cascade.

These objects and advantages of the present invention will become further apparent from the following detailed explanation.

DESCRIPTION OF THE PREFERRED EMBODIMENTS

Various embodiments of the invention will hereunder be described with reference to FIGS. 1 to 14.

Figure 1:
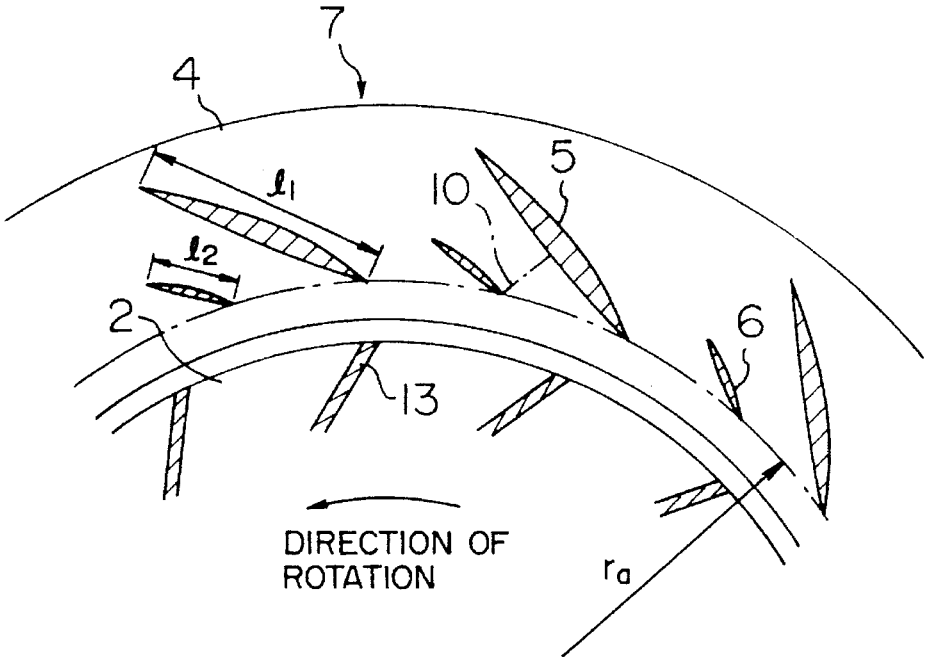
FIG. 1 is a sectional view taken along line I—I in FIG. 2, showing a first example of a centrifugal compressor according to the invention.
Figure 2:
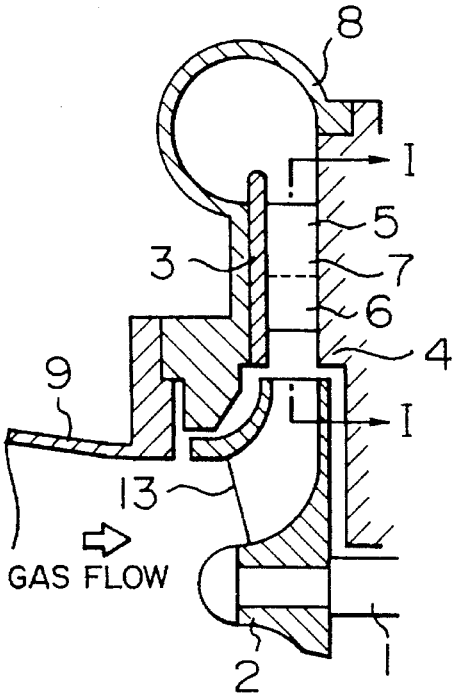
FIG. 2 is a longitudinal cross-sectional view, showing the first example of the centrifugal compressor.

FIGS. 1 and 2 show a first example of a centrifugal compressor and a vaned diffuser according to the invention.

In FIGS. 1 and 2, a vaned diffuser 7 which comprises a pair of opposed diffuser plates 3 and 4 and two kinds of long and short guide vanes 5 and 6 which are different in length from each other and which are arranged between the diffuser plates 3 and 4 in a circular cascade as shown in FIG. 1 is arranged downstream of a centrifugal impeller 2 which is fixedly mounted on a rotary shaft 1 of the centrifugal compressor shown in FIG. 2. That is, the vaned diffuser 7 is provided radially outwardly of the centrifugal impeller 2. Each of the guide vanes 5 has a length $l_1$ which is longer than a length $l_2$ of each of the guide vanes 6 ($l_1>l_2$). The total number of guide vanes 5 and 6 is more than the number of blades (backward blades) 13 of the impeller 2, and is of the order of 1.5 times the latter. The long guide vanes 5 and the short guide vanes 6 are alternately arranged circumferentially as shown in FIG. 1. The long and short guide vanes 5 and 6 are arranged so that their respective leading edges are positioned on a circle of a radius $r_a$. In this connection, the guide vanes 5 and 6 are arranged such that, of a pair of flow passages between the adjoining or adjacent guide vanes 5 and 6, a throat 10 is formed on one of the flow passages, but a throat is not formed in the other flow passage. Further, a scroll casing 8 is provided downstream of the diffuser 7. A suction pipe 9 is arranged upstream of the impeller 2.

Figure 13:
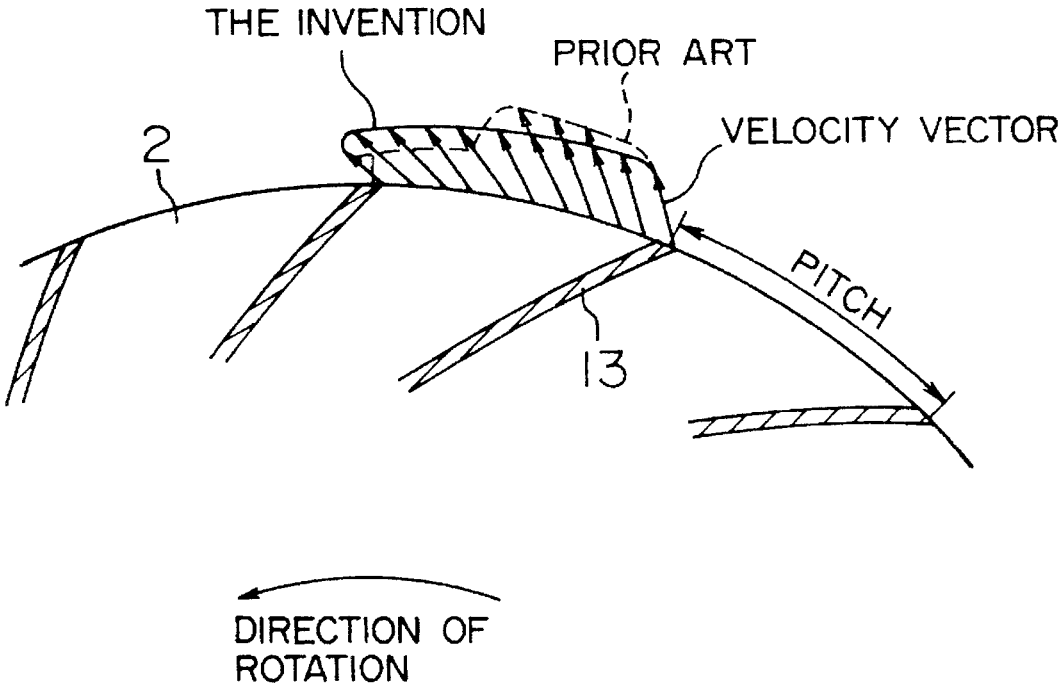
FIG. 13 is a fragmentary enlarged sectional view, showing an impeller of the centrifugal compressor in the invention.
Figure 14:
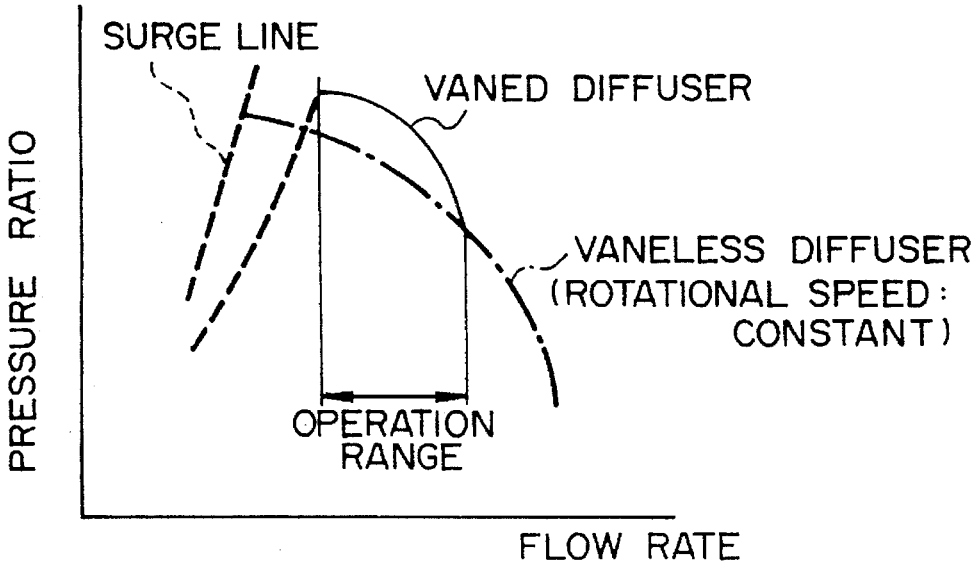
FIG. 14 is a graph showing an characteristic of the centrifugal compressors.

With the arrangement, when the centrifugal compressor runs, flow of gas indicated by an arrow in FIG. 2 passes through the suction pipe 9, and is drawn into the impeller 2 which is rotated in a direction indicated by an arrow in FIG. 1 so that the gas increases in pressure. Subsequently, the gas is discharged from an outlet of the impeller 2. The gas flows into the vaned diffuser 7 and is decelerated within the diffuser 7. Subsequently, the gas flows into the scroll casing 8. In this embodiment, since the total number of long and short guide vanes 5 and 6 is many at the inlet of the vaned diffuser 7, distribution a in a vane pitch direction of a flow velocity vector v at the outlet of the impeller 2 which occurs due to interference between the impeller 2 and the vaned diffuser 7 is uniformized as compared with the conventional distribution b as shown in FIG. 13. As a result, fluctuation in flow is also reduced so that noise is reduced. Further, flow entering into the vaned diffuser 7 is efficiently decelerated by the guide vanes 5 and 6. Since there are only the long guide vanes 5 in the latter half of the flow passage and the number of vanes is reduced, the frictional loss is reduced so that high efficiency is also obtained. Moreover, since the throat 10 is formed only in one of the flow passages between the long and short guide vanes 5 and 6, choke and surge do not occur easily, and it is possible to secure a wide operating range as shown in FIG. 14.

Figure 3:
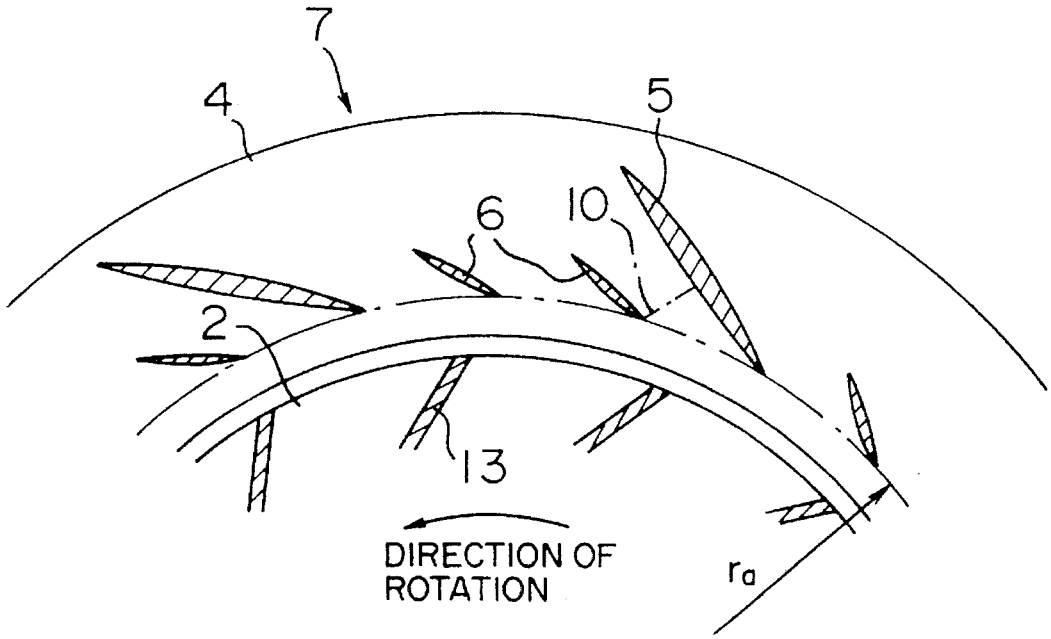
FIG. 3 is a sectional view similar to FIG. 1, showing a second example of the centrifugal compressor according to the invention.

FIG. 3 shows a second example of the centrifugal compressor and the vaned diffuser according to the invention. A vaned diffuser 7 of the centrifugal compressor comprises a pair of diffuser plates 3 and 4 and guide vanes 5 and 6 different in length from each other, which are arranged between the diffuser plates 3 and 4 in the form of a circular cascade. The guide vanes 5 and 6 are arranged so that their respective leading edges are positioned on a circle of a radius $r_a$. The total number of the guide vanes 5 and 6 is of the order of 1.5 times the number of blades 13 of an impeller 2. Referring to FIG. 3, a pair of short guide vanes 6 are arranged between the adjacent long guide vanes 5. The guide vanes 5 and 6 are arranged such that a throat 10 is formed only at one of three flow passages between the adjacent long guide vanes 5. With also the arrangement, when the centrifugal compressor runs, flow distribution at the impeller outlet is uniformized in a pitch direction, since the total number of the guide vanes 5 and 6 of the diffuser 7 is many. Fluctuation in flow is reduced, and noise is reduced. Furthermore, since the frictional loss of the latter half of the flow passage of the vaned diffuser 7 is reduced, there can be produced performance high in efficiency. Further, since the throat 10 is formed only in a portion of the flow passage between blades, surge and choke do not occur easily so that it is possible to secure a wide operating range.

Figure 4:
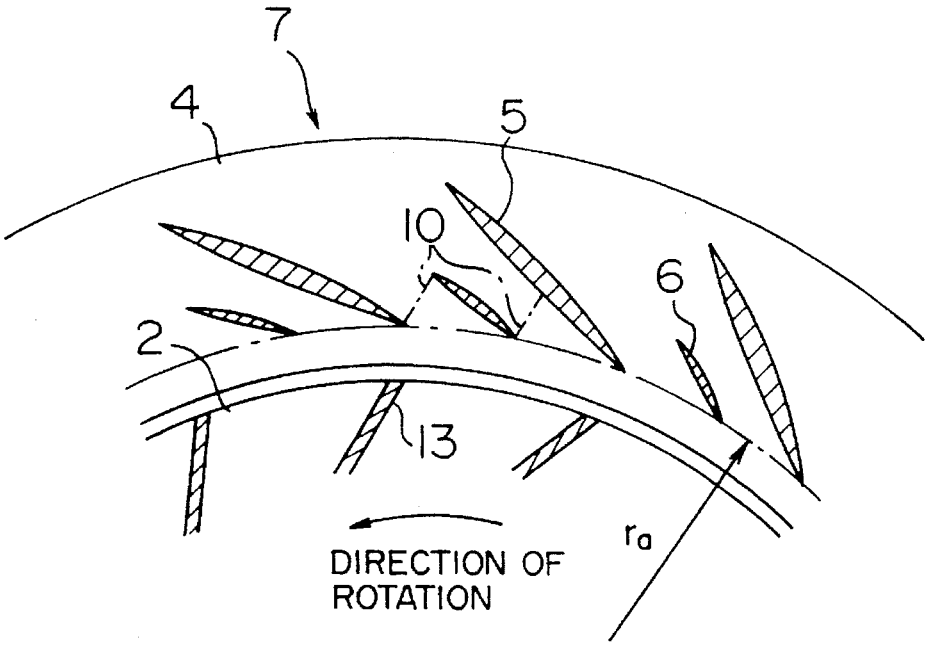
FIG. 4 is a sectional view similar to FIG. 1, showing a third example of the centrifugal compressor according to the invention.

FIG. 4 shows a third example of the centrifugal compressor and the vaned diffuser according to the invention. A vaned diffuser 7 of the centrifugal compressor comprises a pair of diffuser plates 3 and 4 and guide vanes 5 and 6 different in length from each other and arranged between the diffuser plates 3 and 4 in a manner of a circular cascade. The guide vanes 5 and 6 are arranged so that their respective leading edges are positioned on a circle of a radius $r_a$. Referring to FIG. 4, a single short guide vane 6 is arranged between the adjacent long guide vanes 5. A pair of throats 10 are formed respectively in flow passages between the adjacent guide vanes 5 and 6. The total number of the guide vanes 5 and 6 is of the order of 1.8 times blades 13 of the impeller 2. With also the arrangement, when the centrifugal compressor runs, flow distribution of an impeller outlet in the pitch direction is uniformized since the total number of the guide vanes 5 and 6 of the diffuser 7 is further many. Thus, fluctuation in flow is reduced so that noise is further reduced. Moreover, since the frictional loss of the latter half of the flow passage in the vaned diffuser 7 is reduced, there can be provided performance high in efficiency. In this connection, since the throats 10 are formed at all of the flow passages between vanes, surge and choke are easy to occur as compared with the embodiments shown in FIG. 1 and FIG. 3. Thus, the operating range may be slightly narrowed.

Figure 5:
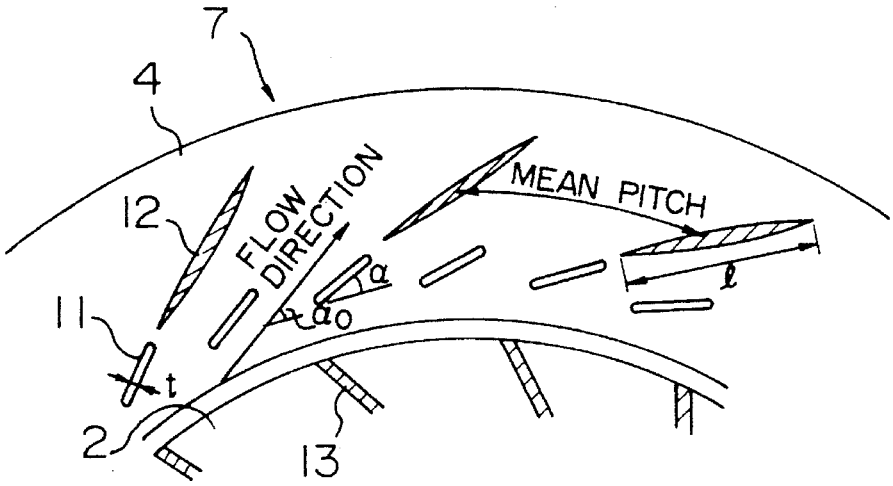
FIG. 5 is a sectional view taken along line V—V in FIG. 6, showing a fourth example of the centrifugal compressor according to the invention.
Figure 6:
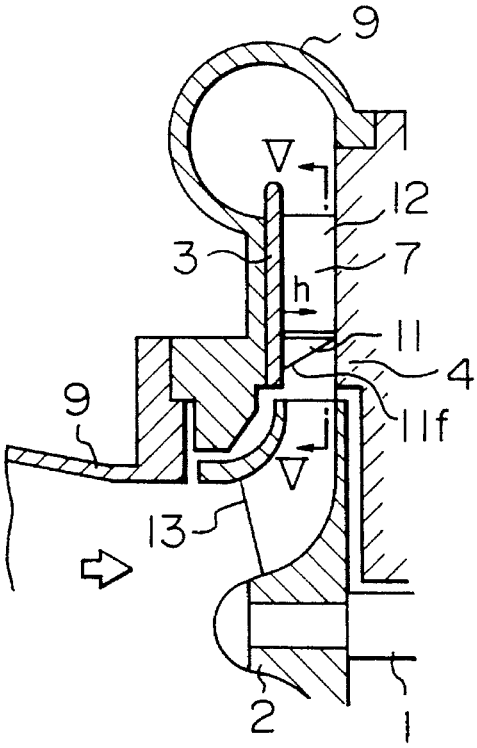
FIG. 6 is a longitudinal cross-sectional view, showing the fourth example of the centrifugal compressor.

FIGS. 5 and 6 show a fourth example of the centrifugal compressor and the vaned diffuser according to the invention. Referring to FIGS. 5 and 6, a vaned diffuser 7 has a pair of diffuser plates 3 and 4 and two kinds of guide vanes 11 and 12 which are arranged between the diffuser plates 3 and 4 and in the form of double circular cascades. The number of short guide vanes 11 provided at an inner circular cascade is twice the number of long guide vanes 12 provided at an outer circular cascade. The number of short guide vanes 11 at the inner circular cascade is more than the number of blades 13 of the impeller 2 and is of the order of 1.5 times the latter. In this connection, the guide vanes 11 at the inner circular cascade are formed by plates which are constant in thickness t, and vane angles $\alpha$ with respect to the tangential direction are constant in the flow direction. As shown in FIG. 6, leading edges radius 11*f* of the vanes 11 vary in a vane height direction between the diffuser plates 3 and 4. Further, a solidity (vane length/cascade mean pitch) of the guide vanes 12 on the outer circular cascade is equal to or less than 1 (one). No throat is formed in any of the flow passages between vanes. Moreover, a gap in a radial direction between the guide vanes 12 and the guide vanes 11 is small. Leading edges of the guide vanes 12 are respectively arranged on extensions of the guide vanes 11.

With the arrangement, when the centrifugal compressor runs, distribution of flow at an outlet of the impeller 2 in a pitch direction is uniformized similarly to the condition shown in FIG. 13, since the number of guide vanes 11 at the inner circular cascade is more than the number of vanes 13 of the impeller 2. Fluctuation of the flow is reduced so that the blade passage frequency component of the noise is reduced. Further, in the embodiment, since the leading edges 11*f* of the guide vanes 11 vary in the vane height direction as shown in FIG. 6, collision or impingement of the flow entering into the diffuser 7 against the guide vanes 11 is timingly dispersed. Accordingly, the blade passage frequency component of the noise is reduced. As a result, the noise of the compressor is considerably reduced. Further, since the vane angles $\alpha$ of the guide vanes 11 at the inner circular cascade are constant in the flow direction, the vane angles $\alpha$ at the leading edges are also constant and are substantially coincident with the flow angle $\alpha_0$. Therefore, the incidence loss of the flow is reduced. Moreover, the frictional loss of the flow passage on the outer circular cascade is reduced, and there can be provided high efficiency. Moreover, since the solidity of each of the guide vanes 12 at the outer circular cascade is low, and since no throat is formed on the flow passage between the vanes 12, it is possible to secure a wide operating range. In this connection, the centrifugal compressor has the following advantages. That is, since the guide vanes 11 at the inner circular cascade are formed by plates each having a constant thickness t, manufacturing thereof is easy. Even the leading edges vary in the vane height direction, performance is not lowered because the vane thickness of the leading edge does not increase.

Figure 7:
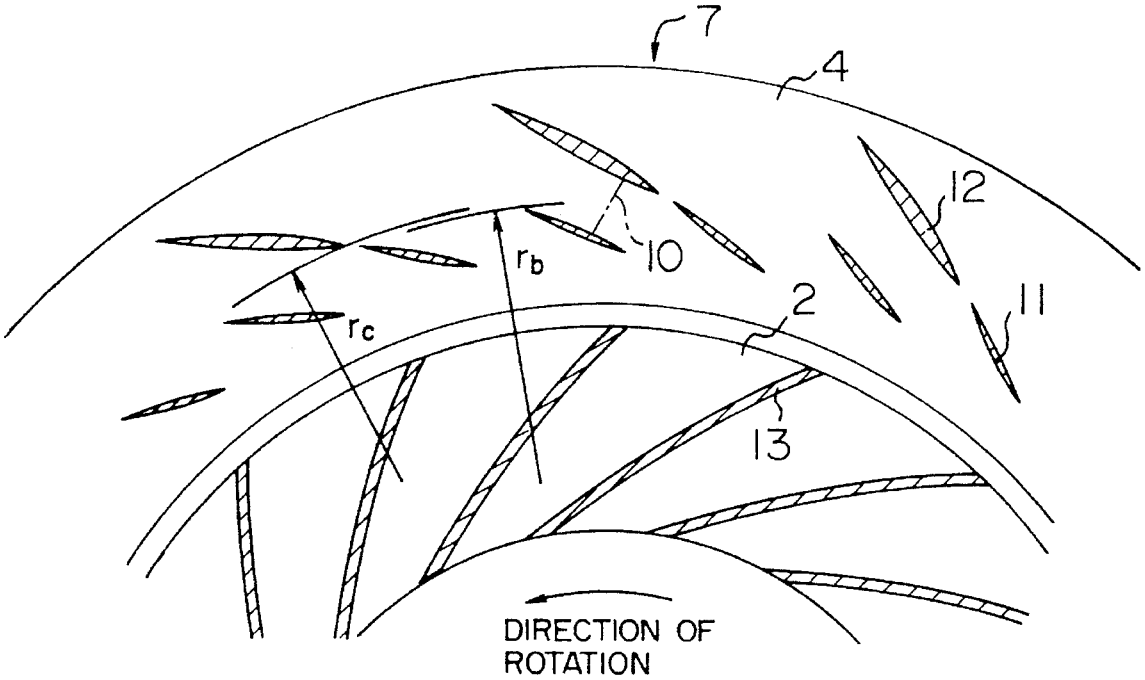
FIG. 7 is a sectional view taken along line VII—VII in FIG. 8, showing a fifth example of the centrifugal compressor according to the invention.
Figure 8:
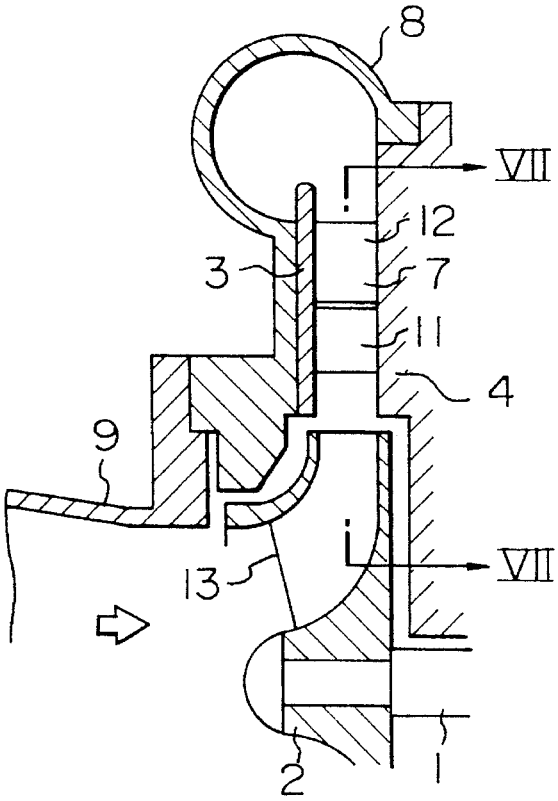
FIG. 8 is a longitudinal cross-sectional view, showing the fifth example of the centrifugal compressor.

FIGS. 7 and 8 show a fifth example of the centrifugal compressor and the vaned diffuser according to the invention. A vaned diffuser 7 has a pair of diffuser plates 3 and 4 and two kinds of guide vanes 11 and 12 arranged between the diffuser plates 3 and 4 in a manner of double circular cascades. The number of short guide vanes 11 at an inner circular cascade is twice the number of long guide vanes 12 of an outer circular cascade, and is of the order of approximately 1.8 times the number of blades (backword blades) 13 of the impeller 2. Moreover, the solidity of the guide vanes 11 and 12 are equal to or less than 1. The guide vanes 12 are arranged so that their respective leading edges are positioned on a circle of a radius $r_c$ while the guide vanes 11 are arranged so that their respective trailing edges are positioned on a circle of a radius $r_b$. The radius $r_c$ is slightly larger than the radius $r_b$. The leading edges of the guide vanes 12 at the outer circular cascade is arranged on extensions of the guide vanes 11 at the inner circular cascade in the lengthwise direction thereof.

With the arrangement, when the centrifugal compressor runs, gas indicated by an arrow in FIG. 8 passes through the suction pipe 9, is drawn into the impeller 2 and is raised in pressure. Subsequently, the gas is discharged from an outlet of the impeller 2, and flows into the diffuser 7. The gas is decelerated within the diffuser 7 and, thereafter, flows into the scroll casing 8. In the embodiment, at the inlet of the diffuser 7, the number of guide vanes 11 at the inner circular cascade is many on the order of approximately 1.8 times of the number of blades 13 of the impeller 2. Accordingly, interference between the centrifugal impeller 2 and the vaned diffuser 7 uniformizes the flow distribution at the impeller outlet in the vane pitch direction similarly to the condition shown in FIG. 13. Thus, fluctuation in flow is also reduced. Accordingly, the blade passage frequency component which is generated by impingement or collision of gas inflow against the guide vanes 11 is reduced and noise is reduced. Further, the flow entering into the diffuser 7 is efficiently decelerated by the two cascades of guide vanes 11 and 12. Since the number of guide vanes 12 in the latter half of the flow passage between vanes are less, the frictional loss is reduced. Thus, there can be provided performance high in efficiency. Furthermore, since a throat 10 is formed only in the half of the flow passage between vanes of the guide vanes 11 and 12, choke and surge do not occur easily. Thus, it is possible to secure a wide operational range. In this connection, since a gap in the radial direction between the guide vanes 11 and the guide vanes 12 is reduced, an outer diameter of the diffuser 7 can be reduced. Accordingly, it is possible to reduce the compressor size.

Figure 9:
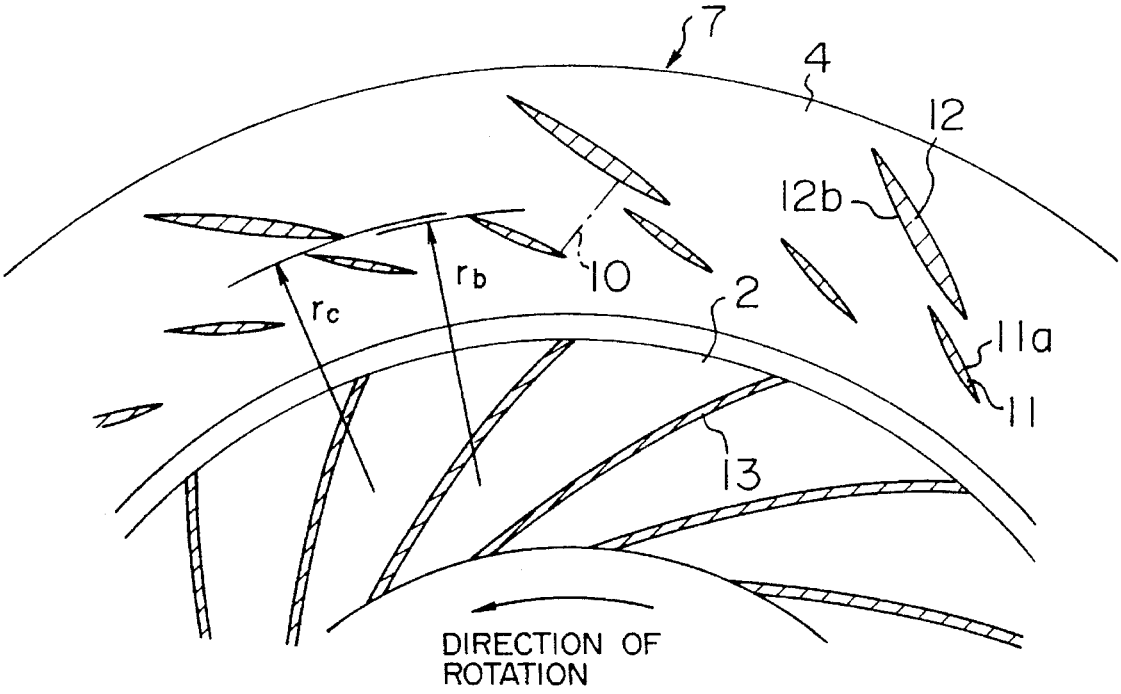
FIG. 9 is a sectional view similar to FIG. 7, showing a sixth example of the centrifugal compressor according to the invention.

FIG. 9 shows a sixth example of the centrifugal compressor and the vaned diffuser according to the invention. A vaned diffuser 7 comprises a pair of diffuser plates 3 and 4, and two kinds of guide vanes 11 and 12 which are arranged between the diffuser plates 3 and 4 in the form of double circular cascades as shown in FIG. 9. The number of short guide vanes 11 at an inner circular cascade is twice the number of long guide vane 12 at an outer circular cascade, and is approximately 1.8 times the number of blades 13 of the impeller 2. Further, the solidity of the guide vanes 11 and 12 are equal to or less than 1. The guide vanes 12 are arranged so that their respective leading edges are positioned on a circle of a radius $r_c$ while the guide vanes 11 are arranged so that their respective trailing edges are positioned on a circle of a radius $r_b$. The radius $r_c$ is slightly larger than the radius $r_b$. The leading edges of the guide vanes 12 are arranged so as to offset peripherally toward pressure surfaces 11*a* of the guide vanes 11 from extensions in a lengthwise direction of the guide vanes 11.

With the arrangement, when the centrifugal compressor runs, flow distribution at an outlet of an impeller 2 is uniformized in a vane pitch direction, and fluctuation in flow is reduced, since the number of the guide vanes 11 at an inner circular cascade are more than the blades 13 of the impeller 2. Thus, the blade passage frequency component of the the noise is reduced. Further, since the frictional loss in the latter half of the flow passage between the vanes is reduced, there can be produced high efficiency. Since a throat 10 is formed only partially in the flow passage between vanes, surge and choke do not occur easily, and it is possible to secure the wide operating range. Moreover, in the present embodiment, since development of boundary layers on suction surfaces 12*b* of the guide vanes 12 on the outer circular cascade is restrained respectively by jet which are blown from narrow flow passages formed or defined between pressure surfaces 11*a* of the guide vanes 11 at the inner circular cascade and the suction surfaces 12*b* of the guide vanes 12 of the second row, performance is improved more than that of the embodiment illustrated in FIG. 7. In this connection, in the present embodiment, a gap in the radial direction between the two cascades of the guide vanes 11 and 12 is reduced. Thus, the compressor size is reduced.

Figure 10:
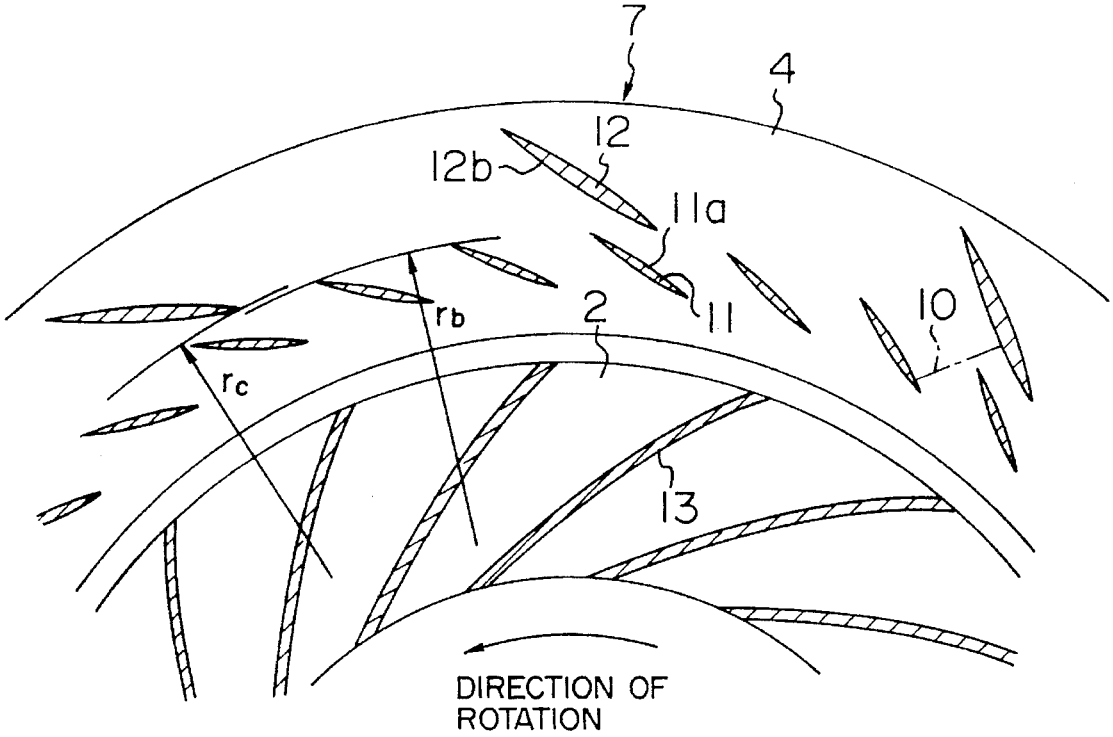
FIG. 10 is a sectional view similar to FIG. 7, showing a seventh example of the centrifugal compressor according to the invention.

FIG. 10 shows a seventh example of the vaned diffuser and the centrifugal compressor according to the invention. The centrifugal compressor has a vaned diffuser 7 which comprises a pair of diffuser plates 3 and 4 and two kinds of guide vanes 11 and 12 which are arranged between the diffuser plates 3 and 4 in the form of double circular cascades as shown in FIG. 10. The number of short guide vane 11 at an inner circular cascade is 3 times the number of long guide vanes 12 at an outer circular cascade, and is approximately 1.8 times the number of blades 13 of an impeller 2. The solidity of the two cascades of guide vanes 11 and 12 are equal to or less than 1. The guide vanes 12 are arranged so that their respective leading edges are positioned on a circle of a radius $r_c$ while the guide vanes 11 are arranged so that their respective trailing edges are positioned on a circle of a radius $r_b$. The radius $r_c$ is slightly larger than the radius $r_b$. The leading edges of the guide vanes 12 are arranged so as to offset in a peripheral direction toward pressure surfaces 11*a* of the guide vanes 11 from extensions in a lengthwise direction of the guide vanes 11.

With also the arrangement, when the centrifugal compressor runs, distribution of flow at the outlet of the impeller 2 in the vane pitch direction is uniformized, and fluctuation in flow is reduced since the number of guide vanes 11 on the inner circular cascade is more than the blades 13 of the impeller 2. Accordingly, the noise of the compressor is reduced. Further, since the frictional loss of the latter half of the flow passage between the vanes is reduced, there can be produced high efficiency. Moreover, since a throat 10 is formed partially only in a flow passage between the vanes, choke and surge do not occur easily so that a wide operating range is secured. Furthermore, since a gap in the radial direction between the two cascades of guide vanes 11 and 12 is reduced, it is possible to reduce the compressor size. Further, development of the boundary layer on a suction surface 12*b* of the guide vane 12 is restrained by jet which is blown off from the narrow flow passage which is formed between the pressure surface 11*a* of the guide vane 11 and the suction surface 12*b* of the guide vane 12. Thus, the diffuser performance, i.e., the compressor performance is improved.

Figure 11:
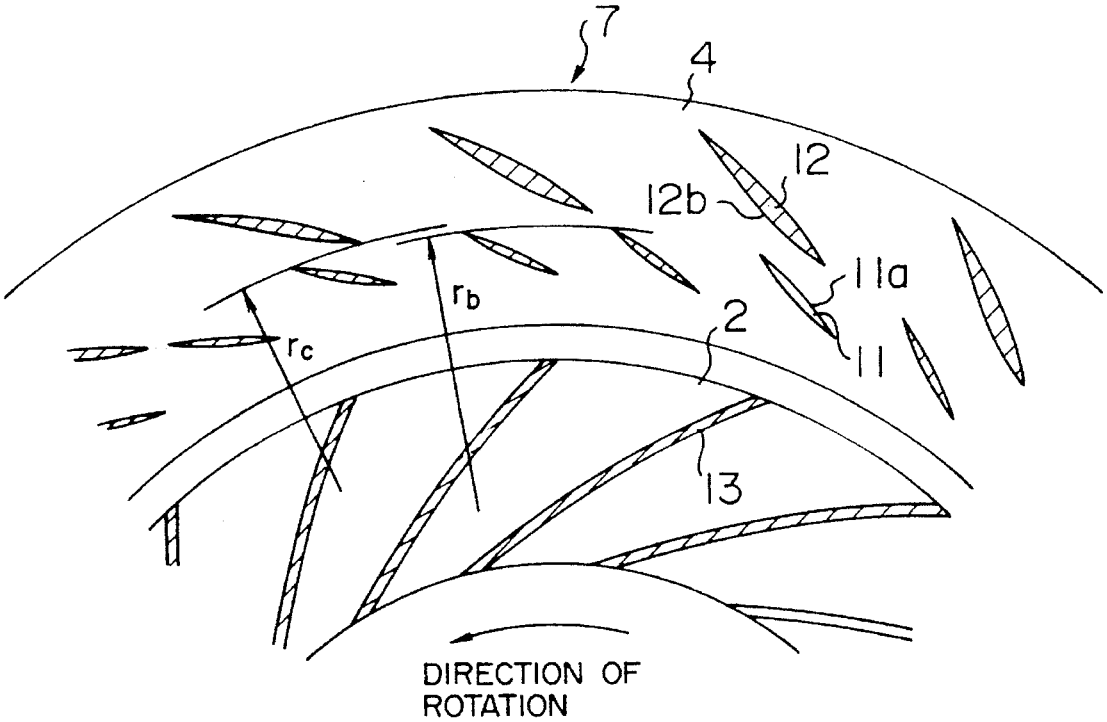
FIG. 11 is a sectional view similar to FIG. 7, showing an eighth example of the centrifugal compressor according to the invention.

FIG. 11 shows an eighth example of the centrifugal compressor and the vaned diffuser according to the invention. A vaned diffuser 7 comprises a pair of diffuser plates 3 and 4 and two kinds of guide vanes 11 and 12 which are arranged between the diffuser plates 3 and 4 in the form of double circular cascades as shown in FIG. 11. The number of short guide vanes 11 on an inner circular cascade is 1.5 times the number of long guide vanes 12 on an outer circular cascade, and is of the order of approximately 1.8 times the number of blades 13 on the impeller 2. The solidities of the respective guide vanes 11 and 12 on the two cascades are equal to or less than 1. The guide vanes 12 are arranged so that their respective leading edges are positioned on a circle of a radius $r_c$ while the guide vanes 11 are arranged so that their respective trailing edges are positioned on a circle of a radius $r_b$. The radius $r_c$ is slightly larger than the radius $r_b$. A half of the guide vane 12 on the outer circular cascade have respective leading edges thereof which are so arranged as to be positioned on extensions in a lengthwise direction of the guide vanes 11.

With the arrangement, when the centrifugal compressor runs, flow from an outlet of the impeller 2 is uniformized in a vane pitch direction, since the number of guide vanes 11 on the inner circular cascade is more than the blades 13 of the impeller 2. Thus, fluctuation in flow is reduced. Accordingly, the noise of the compressor is reduced. Further, since the frictional loss of the latter half of the flow passage between the vanes of the diffuser 7 is reduced, there can be produced high efficiency. Moreover, since a throat 10 is formed partially in the flow passage between the vanes of two cascades of guide vanes 11 and 12, it is possible to secure a wide operating range. Furthermore, development of the boundary layers of suction surfaces 12*b* of the guide vanes on the outer circular cascade is restrained by jet which is blown from a narrow flow passage formed between suctionsurface 12*b* of the guide vanes 12 and the pressure surface 11*a* of the guide vanes 11. Accordingly, performance is further improved.

Figure 12:
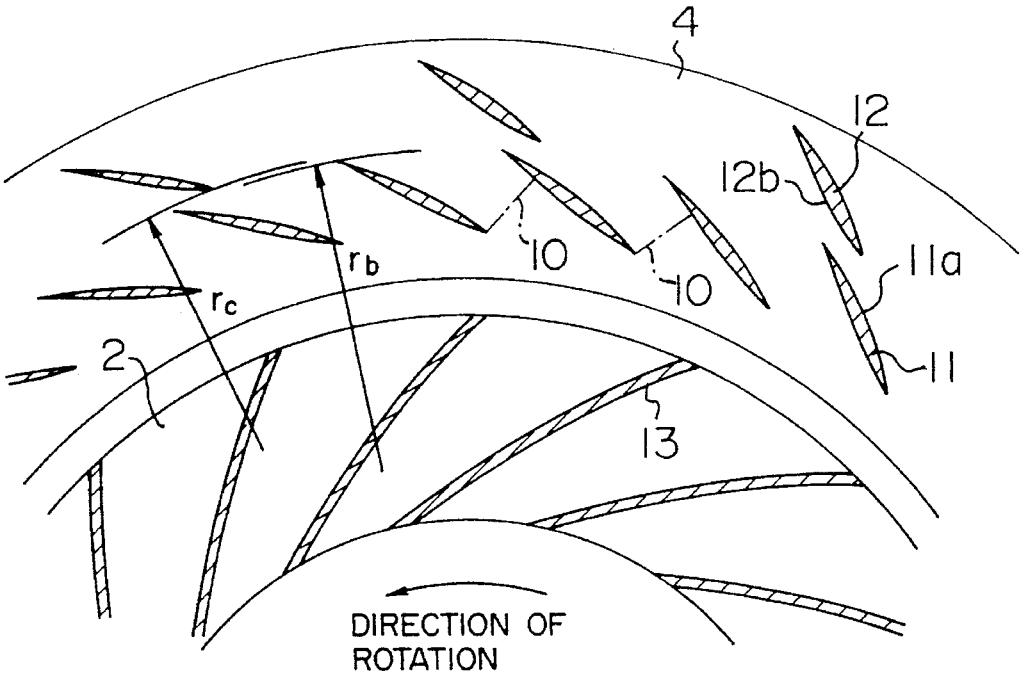
FIG. 12 is a sectional view similar to FIG. 7, showing a ninth example of the centrifugal compressor according to the invention.

FIG. 12 shows a ninth example of the centrifugal compressor and the vaned diffuser according to the invention. In this connection, radial lengths of the guide vanes 11 and 12 are different from those in FIG. 11. The vaned diffuser 7 of the centrifugal compressor comprises a pair of diffuser plates 3 and 4 and two kinds of guide vanes 11 and 12 which are arranged between the diffuser plates 3 and 4 in the form of double circular cascades as shown in FIG. 12. The guide vanes 11 provided at an inner circular cascade are slightly longer than the guide vanes 12 provided at an outer circular cascade. The number of slightly longer guide vanes 11 on the inner circular cascade is twice the number of slightly short guide vanes 12 on the outer circular cascade, and is approximately 1.8 times the number of blades 13 on the impeller 2. Further, the solidity of the guide vanes 11 of the inner circular cascade is greater or larger than 1, and a throat 10 is formed at all the flow passage between vanes 11. The solidity of the guide vane 12 of the outer circular cascade is equal to or less than 1, and a throat 10 is not formed in the flow passage between vanes 12. The leading edges of the guide vanes 12 of the outer circular cascade are so arranged as to offset peripherally toward pressure surfaces 12*a* from extensions of the guide vanes 11.

With also the arrangement, when the centrifugal compressor runs, the flow at the outlet of the impeller 2 is uniformized in the vane pitch direction, and fluctuation in flow is reduced, since the number of guide vanes 11 on the inner circular cascade of the diffuser 7 is more than the blades 13 of the impeller 2. Thus, the noise of the compressor is reduced. Further, since the frictional loss of the latter half of the flow passage between the vanes is reduced, there can be produced performance high in efficiency. In this connection, since the throats 10 are formed in all of the flow passages between vanes of the guide vanes 11 on the inner circular cascade, surge and choke are apt to occur as compared with the embodiments illustrated in FIG. 9 to FIG. 11. Thus, there is possibility that the operating range is slightly narrowed.

In connection with the above, the embodiments illustrated in FIG. 1 to FIG. 4 are arranged such that the total number of guide vanes 5 and 6 of the diffuser 7 is about 1.5 times or 1.8 times the number of the blades 13 of the impeller 2. The embodiments illustrated in FIG. 5 to FIG. 12 are arranged such that the total number of guide vanes 5 and 6 of the diffuser 7 is approximately of the order of 1.5 times or 1.8 times the number of blades 13 of the impeller 2. However, it is possible that these numbers of vanes are within a range of from 1.5 times to 1.9 times. However, if this is equal to or less than 1.5 times, function of uniformizing flow distribution at the outlet of the impeller 2 in the vane pitch direction is reduced, and the blade passage frequency component which is dominant to the noise of the compressor cannot be reduced. Moreover, if it is equal to or larger than the order of 1.9 times, the efficiency falls in view of the reasons that frictional loss increases because the number of vanes of the diffuser 7 increases, and that deceleration is reduced because the vane length is short. In this connection, in the embodiments illustrated in FIG. 7 to FIG. 12, the leading edge redius of the guide vane 11 on the inner circular cascade may vary in the vane height direction as is in the embodiment illustrated in FIGS. 5 and 6. Moreover, in the embodiments illustrated in FIG. 7 to FIG. 12, the length relationship of the two kinds of guide vanes 11 and the guide vanes 12 should not be limited to one illustrated, and is not particularly specified. In this connection, the present embodiments have been described regarding the vaned diffuser which is applied to the centrifugal compressor. However, the vaned diffuser according to the invention should not be limited to a centrifugal compressor, but can similarly be applied to a centrifugal fluid machine such as a centrifugal blower, a centrifugal pump, and the like.

According to the invention, non-uniformity of the flow distribution in the pitch direction at the impeller outlet of the centrifugal compressor is reduced and, accordingly, a fluctuation component of the flow entering into the vaned diffuser is reduced. Thus, the noise that the blade passage frequency component is dominant is reduced, and the compressor noises are considerably reduced. Further, since the frictional loss of the vaned diffuser can also be reduced, the efficiency of the compressor is also improved.

Further, according to the invention, non-uniformity of the flow distribution in the pitch direction at the outlet of the impeller of the centrifugal compressor is reduced and, accordingly, the fluctuating component of the flow entering into the vaned diffuser is reduced. Thus, the blade passage frequency component dominant to the noise is reduced, and the compressor noises are considerably reduced. Moreover, when the leading edges radius of the guide vanes on the inner circular cascade vary in the vane height direction, the compressor noises are further reduced.

Furthermore, according to the invention, non-uniformity of the flow distribution in the pitch direction at the outlet of the impeller of the centrifugal compressor is reduced and, accordingly, a fluctuating component of the flow entering into the vaned diffuser is reduced. Accordingly, the noises that the blade passage frequency component is dominant is reduced, and the compressor noises are considerably reduced. Moreover, there is an advantage that, since frictional loss of the diffuser is reduced, efficient of the compressor is also improved.

What is claimed is:

1. A central compressor comprising:

a centrifugal impeller; and a vaned diffuser arranged downstream of said impeller and including a pair of diffuser plates and a plurality of guide vanes arranged between said pair of diffuser plates in a circular cascade manner;

wherein said circular cascade of said vaned diffuser comprises an inner circular cascade and an outer circular cascade disposed radially outwardly of the inner circular cascade, wherein the number of guide vanes of the inner circular cascade is more than the number of blades of said impeller, and wherein a leading-edge radius of the guide vanes of the outer circular cascade is substantially the same in level as a trailing-edge radius of the guide vanes of the inner circular cascade, and wherein the number of guide vanes of the inner circular cascade of said vaned diffuser is 1.5 times to 1.9 times the number of blades of said impeller.

2. A centrifugal compressor comprising:

a centrifugal impeller; and a vaned diffuser arranged downstream of said impeller and including a pair of diffuser plates and a plurality of guide vanes extending from one diffuser plate to the other diffuser plate in a circular cascade manner;

wherein said circular cascade of said vaned diffuser comprises an inner circular cascade and an outer circular cascade disposed radially outwardly of the inner circular cascade, wherein the number of guide vanes of the inner circular cascade is larger than the number of blades of said impeller wherein a leading-edge radius of the guide vanes of the outer circular cascade is substantially the same in level as a trailing-edge radius of the guide vanes of the inner circular cascade, and wherein the number of guide vanes of the inner circular cascade of said vaned diffuser is more than a number of guide vanes of the outer circular cascade.

3. A centrifugal compressor according to claim 2, wherein each of the guide vanes of the inner circular cascade of the vaned diffuser has a solidity which is equal to or less than 1.

4. A centrifugal compressor according to claim 2, wherein the leading edge of each of the guide vanes of the outer circular cascade of said vaned diffuser is different in position in a peripheral direction from the trailing edge of an associated one of the guide vanes of the inner circular cascade.

5. A vaned diffuser arranged downstream of an impeller and including a pair of diffuser plates and a plurality of guide vanes extending from one diffuser plate to the other diffuser plate in a circular cascade manner;

wherein said circular cascade of said vaned diffuser comprises an inner circular cascade and an outer circular cascade, wherein the number of guide vanes of the inner circular cascade is more than the number of blades of said impeller, wherein the number of guide vanes of the inner circular cascade is larger than the number of guide vanes of the outer circular cascade disposed radially outwardly of the inner circular cascade, and wherein leading-edge radius of the guide vanes of the outer circular cascade is substantially the same in level as trailing-edge radius of the guide vanes of the inner circular cascade.

* * * * *